US011610718B2

(12) United States Patent
Li et al.

(10) Patent No.: US 11,610,718 B2
(45) Date of Patent: Mar. 21, 2023

(54) ELECTRICAL INDUCTOR DEVICE

(71) Applicant: FORD GLOBAL TECHNOLOGIES, LLC, Dearborn, MI (US)

(72) Inventors: Wanfeng Li, Novi, MI (US); Chuanbing Rong, Canton, MI (US); Michael W. Degner, Novi, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 790 days.

(21) Appl. No.: 16/579,117

(22) Filed: Sep. 23, 2019

(65) Prior Publication Data

US 2021/0090779 A1 Mar. 25, 2021

(51) Int. Cl.

| | |
|---|---|
| ***H01F 27/24*** | (2006.01) |
| ***H01F 27/245*** | (2006.01) |
| ***H01F 3/10*** | (2006.01) |
| ***H01F 41/02*** | (2006.01) |
| ***H01F 27/255*** | (2006.01) |

(52) U.S. Cl.

CPC ..... *H01F 27/245* (2013.01); *H01F 3/10* (2013.01); *H01F 27/255* (2013.01); *H01F 41/0233* (2013.01)

(58) Field of Classification Search

USPC ..... 336/212, 221, 232

See application file for complete search history.

(56) References Cited

U.S. PATENT DOCUMENTS

| | | | | |
|---|---|---|---|---|
| 4,943,793 | A * | 7/1990 | Ngo | H01F 3/10 336/212 |
| 5,573,859 | A * | 11/1996 | Suppelsa | B23K 35/0244 428/548 |
| 7,532,099 | B2 | 5/2009 | Brunner | |
| 9,818,519 | B2 | 11/2017 | Miyamura et al. | |
| 2008/0074230 | A1 | 3/2008 | Chen et al. | |
| 2011/0198118 | A1* | 8/2011 | Fang | H05K 9/0098 174/391 |
| 2014/0272452 | A1* | 9/2014 | Kamidaki | H05K 9/0098 428/611 |
| 2016/0233009 | A1* | 8/2016 | Mieno | H01B 1/023 |

* cited by examiner

*Primary Examiner* — Shawki S Ismail
*Assistant Examiner* — Kazi S Hossain
(74) *Attorney, Agent, or Firm* — David B Kelley; Brooks Kushman P.C.

(57) ABSTRACT

An inductor that is configured to store energy in a magnetic field includes a wire and a core. The wire is configured to deliver electrical current to the inductor to generate the magnetic field. The core is disposed radially about the wire. The core comprises magnetic particles that are suspended in a non-magnetic matrix. The magnetic particles are arranged such that a magnetic permeability of the core increases in a direction that extends radially outward from the wire along a cross-sectional area of the magnetic core from a first region that is adjacent to the wire to a second region that is adjacent to an outer periphery of the magnetic core.

17 Claims, 3 Drawing Sheets

ELECTRICAL INDUCTOR DEVICE

TECHNICAL FIELD

The present disclosure relates to electrical inductor devices that include an electrical conductor, such as a wire or coil, and a magnetic core.

BACKGROUND

Electrical inductor devices may include an electrical wire (e.g., a coil) that is configured to generate a magnetic field when energized.

SUMMARY

An inductor that is configured to store energy in a magnetic field includes a magnetic core and an electrical conductor. The magnetic core defines a central orifice. The magnetic core comprises a magnetic powder suspended in a non-magnetic matrix. The magnetic powder has spherically-shaped particles and flake-Shaped particles that are arranged such that a ratio of the flake-shaped particles to the spherically-shaped particles increases in a direction that extends radially outward from the central orifice along a cross-sectional area of the magnetic core from a first region that is adjacent to the central orifice to a second region that is adjacent to an outer periphery of the magnetic core. The spherically-shaped particles and the flake-shaped particles are also arranged such that a magnetic permeability of the magnetic core increases in the direction that extends radially outward from the central orifice along the cross-sectional area of the magnetic core. The electrical conductor is disposed within the central orifice and is configured to deliver electrical current to the inductor to generate the magnetic field for energy storage.

An inductor that is configured to store energy in a magnetic field includes a wire and a core. The wire is configured to deliver electrical current to the inductor to generate the magnetic field. The core is disposed radially about the wire. The core comprises magnetic particles that are suspended in a nonmagnetic matrix. The magnetic particles are arranged such that a magnetic permeability of the core increases in a direction that extends radially outward from the wire along a cross-sectional area of the magnetic core from a first region that is adjacent to the wire to a second region that is adjacent to an outer periphery of the magnetic core.

A method of forming an inductor includes forming a sheet of composite material that includes flake-shaped magnetic particles suspended in a non-magnetic matrix, increasing the density of the flake-shaped magnetic particles in a longitudinal direction along the sheet from a first region that is adjacent to a first lateral side of the sheet to a second region that is adjacent to a second lateral side of the sheet while forming the sheet, rolling the sheet in the longitudinal direction to form a magnetic core that defines a central orifice, wherein the density of the flake-shaped magnetic particles increases in a direction that extends radially outward from the central orifice along a cross-sectional area of the formed magnetic core from a third region that is adjacent to the central orifice to a fourth region that is adjacent to an outer periphery of the magnetic core, and wherein a magnetic permeability of the magnetic core increases in the direction that extends radially outward from the central orifice along the cross-sectional area of the formed magnetic core.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

An inductor is configured to Mom energy in a magnetic field when electric current flows through the coil (e.g., see wire 14 below) of the inductor. Depending on the materials used in the core, the inductor can be classified as an "air core" design, a "laminated core" design, and/or a "powder core" design. In a powder core inductor design, the core may be constructed from ferromagnetic powders that are surrounded by an electrical insulating non-magnetic matrix, which may be a binder material or polymer-based material such as epoxy. A powder core inductor is a distributed air gap core that may possess desired properties, such as high resistivity, low eddy current loss, and good inductance stability.

A distributed air gap inductor design is effective in reducing fringing effect loss. Also, in a distributed air gap inductor design there may be inhomogeneous flux distribution when the device is in operation. The inhomogeneity is caused by the equivalent reluctance along different flux paths. In a homogeneous core, or a core having a single magnetic permeability value throughout the core, the area close to the conductor has higher flux density while the external area has very low flux density when there is current flowing in the conductor. In other words, the external portion of the core may contribute less to the performance of the inductor. To address the problem, an inhomogeneous core that reduces magnetic permeability discrepancies within a core of an inductor is disclosed herein.

Figure 1:
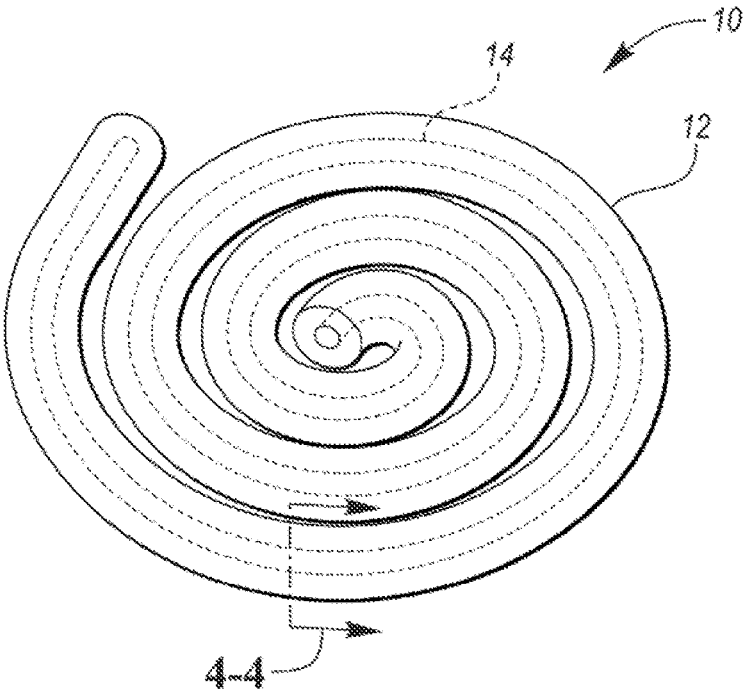
FIG. 1 illustrates an exemplary electrical inductor, specifically a spiral electrical inductor.

Referring to FIG. 1, an electrical inductor 10 is illustrated. The electrical inductor 10 may be spiral electrical inductor. The electrical inductor 10 includes a magnetic inductor core 12 and an electrical conductor or wire 14 (which may be referred to as a coil) that is disposed within the magnetic inductor core 12. More specifically, the wire 14 may be disposed within a central orifice that is defined by the magnetic inductor core 12. The wire 14 is configured to deliver electrical current to the inductor 10 and to generate a magnetic field. The magnetic inductor core 12 may be made from a ferromagnetic material. When an electrical power source, such as a battery or a generator, is connected to terminals (not shown) of the wire 14 and delivers electricity to the wire 14, the wire 14 is energized and generates a magnetic field. The magnetic inductor core 12 may amplify the magnetic field generated by the wire 14. It should be understood that the electrical inductor 10 of FIG. 1 is for illustrative purposes only and that the electrical inductor 10 may have an alternative shape.

Figure 2A:
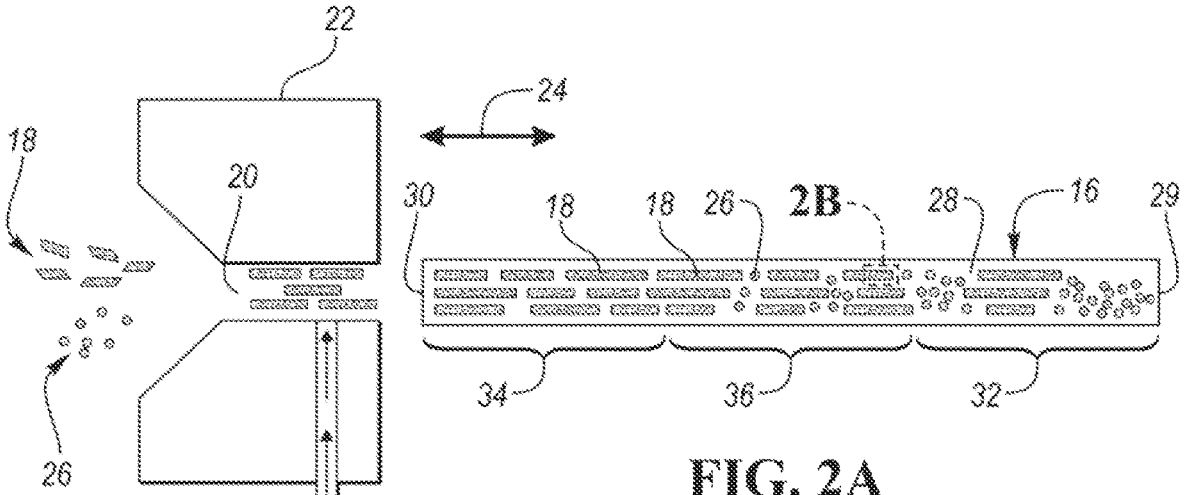
FIG. 2A illustrates an extrusion process for forming a sheet made from a composite material.
Figure 2B:
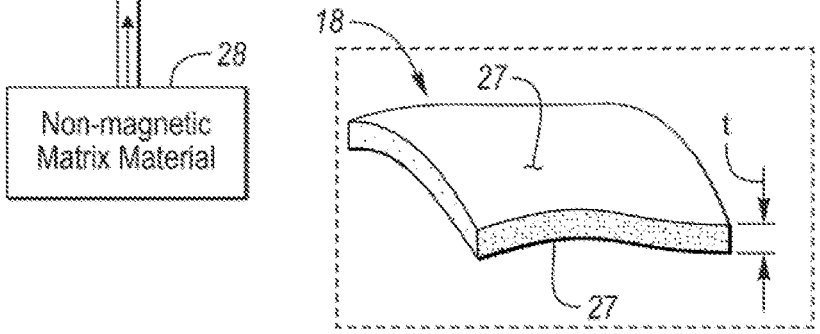
FIG. 2B is a magnified view of the area 2B outlined in FIG. 2A.

Referring to FIG. 2A, an extrusion process for forming a sheet of composite material 16 is illustrated. The sheet 16 may then be used to construct the magnetic inductor core 12 of the inductor 10. A powder having flake-shaped magnetic particles 18 is forced through a slit 20 defined by an extrusion die 22 to align the flake-shaped magnetic particles 18 along a linear path or along a longitudinal direction 24. The powder may be a mixture of the flake-shaped magnetic particles 18 and a second type of particles 26. A flake-shaped particle is a particle that has a pair of substantially parallel and planar exterior surfaces 27 that are separated by a thickness, t, as illustrated in FIG. 2B. A ratio of the lengths or the widths of the pair of substantially parallel and planar exterior surfaces 27 to the thicknesses, t, of the flake-shaped magnetic particles 18 may range between 3:1 and 100,000:1. The substantially parallel and planar exterior surfaces 27 of the flake-shape particle may form any shape. For example, the substantially parallel and planar exterior surfaces 27 may be circular-shaped, oval-shaped, rectangular-shaped, square-shaped, parallelogram-shaped, etc. Substantially parallel may refer to any incremental value that is between exactly parallel and 15° from exactly parallel. The pair of substantially parallel and planar exterior surfaces 27 may have either linear or non-linear contours that remain substantially parallel relative to each other.

The flake-shaped magnetic particles 18 and the second type of particles 26 may be mixed prior to forcing the mixture of the flake-shaped magnetic particles 18 and the second type of particles 26 through the slit 20 defined by the extrusion die 22. The second type of particles 26 may be spherically-shaped particles, may be non-magnetic particles, may be magnetic particles that are not flake-shaped (e.g., spherically-shaped magnetic particles), or any combination thereof. The powder may be mixed with a non-magnetic matrix material 28 such that the particles of the powder (i.e., the flake-shaped magnetic particles 18 and the second type of particles 26) are suspended in the non-magnetic matrix material 28. The non-magnetic matrix material 28 may be a binder material or a polymer-based material such as epoxy. The powder and the non-magnetic matrix material 28 are then output from the die 22 to from the sheet of composite material 16 where the flake-shaped magnetic particles 18 are aligned along the longitudinal direction 24 within sheet of composite material 16. Alternatively, the powder may be coated with the non-magnetic matrix material 28 before the extrusion process.

According to the desired magnetic permeability of the magnetic inductor core 12, different ratios of the flake-shaped magnetic particles 18 and the second type of particles 26 may be utilized, to construct the sheet of composite material 16, which is then utilized to construct the magnetic inductor core 12. It should be noted that the setup of the extrusion process may be different than illustrated. For example, the powder may alternatively be forced through a gap between two rotating drums or wheels. During the extrusion process, the powder may be heated to increase the flowability of the power and to promote alignment of the flake-shaped magnetic particles 18 in the longitudinal direction 24. The slit 20 width may decrease gradually to further promote alignment of the flakes in the longitudinal direction 24. Particles having an irregular shape or spherical shape (e.g., the second type of particles 26) have a larger equivalent air gap relative to the aligned flake-shaped magnetic particles 18. Therefore, the addition of particles having an irregular shape or spherical shape (e.g., the second type of particles 26) decreases the magnetic permeability of the sheet of composite material 16 and ultimately of the magnetic inductor core 12, while the addition of the aligned flake shaped magnetic particles 18 increases the magnetic permeability of the sheet of composite material 16 and ultimately the magnetic inductor core 12, which is constructed from the sheet of composite material 16.

By altering or changing the ratio of the flake-shaped magnetic particles 18 to the second type of particles 26, the magnetic permeability of the sheet of composite material 16 and ultimately the magnetic inductor core 12 may be modulated. For example, in FIG. 2A, the ratio of the flake-shaped magnetic particles 18 to the second type of particles 26 may be varied or gradually increased during the extrusion process such that the magnetic permeability of the sheet of composite material 16 gradually increases from a first end 29 of the sheet 16 to a second end 30 of the sheet 16. A first region 32 of the sheet 16 that is adjacent to the first end 29 may have a ratio of the flake-shaped particles 18 to the second type of particles 26 that ranges between 1:1 and 2:1, a second region 34 of the sheet 16 that is adjacent to the second end 30 may have a ratio of the flake-shaped particles 18 to the second type of particles 26 that ranges between 4:1 and 100:1, and a third region 36 that is between the first and second regions may have a ratio of the flake-shaped particles 18 to the second type of particles 26 that ranges between 2:1 and 4:1. It should be noted that the powder may be completed comprised of flake-shaped particles 18 toward the second end 30 of the sheet 16. Alternatively, there may be no spherical or irregular shaped powders. The variation of permeability may also be achieved by increasing the ratio of the binder (i.e., the non-magnetic matrix material 28) or other non-ferromagnetic materials.

Figure 3:
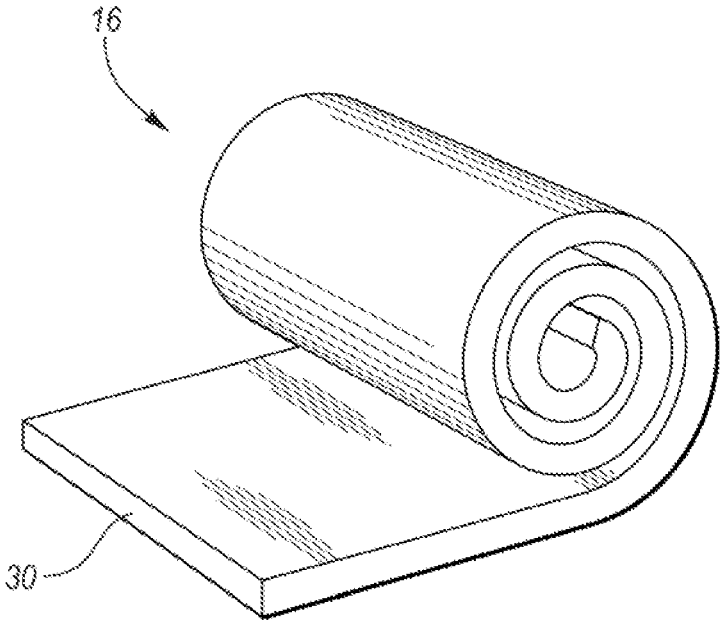
FIG. 3 illustrates a process of rolling the sheet to form a core for the electrical inductor.

The sheet of composite material 16 may be rolled up and further manufactured into different shapes. As illustrated in FIG. 3, the sheet 16 may be rolled up from the right-hand side (i.e., from the first end 29) to the left-hand side (i.e., to the second end 30). The resultant cylinder has a lower magnetic permeability in the center due to the lower ratio of flake-shaped particles 18 to the second type of particles 26 and higher magnetic permeability near the outer peripheral surface due to the higher ratio of the flake-shaped particles 18 to the second type of particles 26. The resultant cylinder is then used to form the magnetic core 12.

Figure 4:
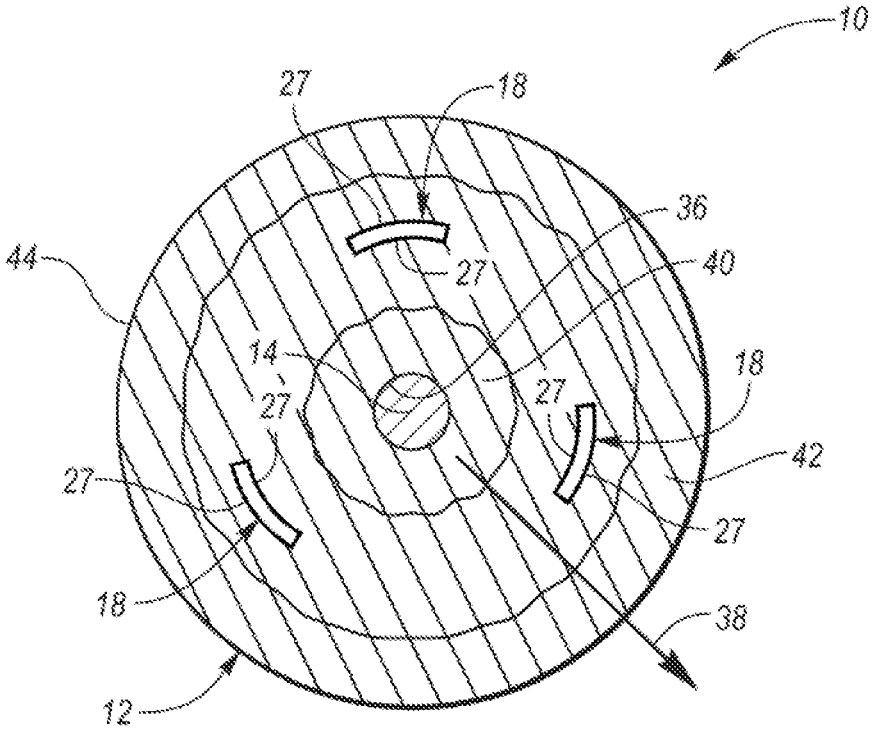
FIG. 4 is a cross-sectional view taken along line 4-4 in FIG. 1.

Referring now to FIG. 4, a cross-sectional view of the inductor 10 is illustrated. The magnetic inductor core 12 defines a central or centrally located orifice 36. The wire 14 is disposed within the central orifice 36 and the magnetic inductor core 12 is disposed radially about the wire 14. Alternatively, the sheet 16 may be rolled directly over the wire 14 to form the inductor 10. Once the wire 14 is disposed within the central orifice 36, the magnetic inductor core 12 and the wire 14 may be collectively wound into inductors of different shapes. For example, the magnetic inductor core 12 and the wire 14 may be collectively wound into a spiral shape such that the inductor 10 is a spiral inductor as shown in FIG. 1. Furthermore, once the sheet 16 has been rolled up the pair of substantially parallel and planar exterior surfaces 27 of each flake-shaped particle 18 are arranged to extend concentrically about the central orifice 36 and/or the wire 14

The magnetic permeability of the magnetic inductor core 12 increases in a direction 38 that extends radially outward from the central orifice 38 and wire 14 along a cross-sectional area of the magnetic inductor core 12. More, specifically, the magnetic permeability of the magnetic inductor core 12 may increase in the radial direction 38 extending from a first region 40 that is adjacent to the central orifice 36 to a second region 42 that is adjacent to an outer periphery 44 of the magnetic inductor core 12, along a cross-sectional area of the magnetic inductor core 12 due to the lower ratio of flake-shaped particles 18 to the second type of particles 26 near the central orifice 36 and due to the higher ratio of the flake-shaped particles 18 to the second type of particles 26 near the outer periphery 44. The increase in magnetic permeability and the increase in the ratio of the flake-shaped particles 18 to the second type of particles 26 in the radial direction 38 may be gradual. A ratio of the flake-shaped particles 18 to the second type of particles 26 may range between 1:1 and 2:1 in the first region 40 and between 4:1 and 100:1 in the second region 42.

As the magnetic permeability is controlled by the microstructure of the sheet 16, different designs are feasible by varying the ratio of the flake-shaped particles 18 to the second type of particles 26. Therefore, any desired permeability distribution may be achieved. By utilizing the sheet 16 as the construction unit, different types of inductors may be manufactured. For example, the spiral inductor design illustrated in FIG. 1 may be constructed by rolling the sheet 16 around a conductor (e.g., wire 14) followed by winding the combined sheet 16 and conductor into spiral shape.

Figure 5:
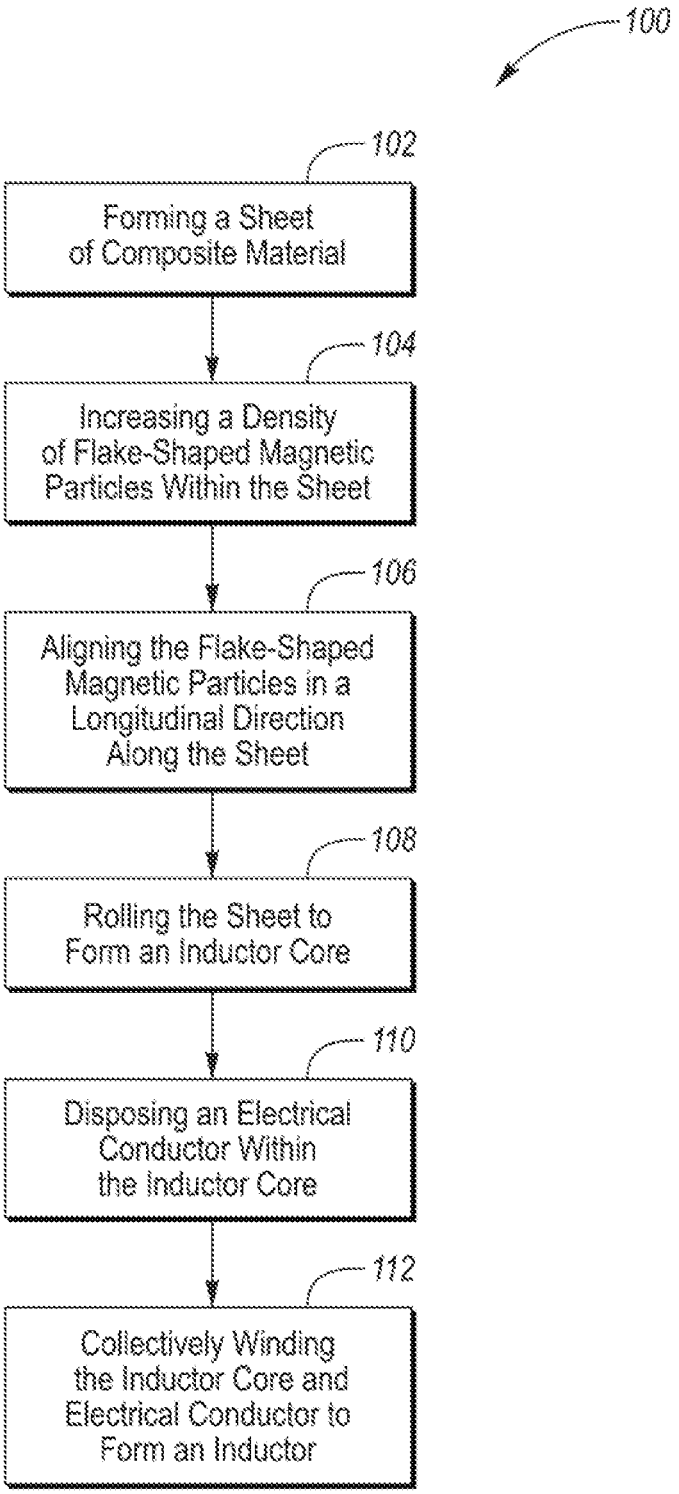
FIG. 5 is a flowchart illustrating a process or method of forming the core and the electrical inductor.

Referring to FIG. 5, a flowchart of a process or method 100 of forming the magnetic inductor core 12 and the electrical inductor 10 is illustrated. The method 100 begins at block 102 by forming the sheet of composite material 16 that includes the flake-shaped magnetic particles 18 suspended in the non-magnetic matrix 28. The sheet of composite material 16 may also include the second type of particles 26 as described above. Next, the method 100 moves on to block. 104 where the density of the flake-shaped magnetic particles 18 is increased in the longitudinal direction 24 along the sheet 16 from the first region 32 that is adjacent to the first end 29 of the sheet 16 to the second region 34 that is adjacent to a second end 30 of the sheet. Alternatively or in addition to increasing the density of the flake-shaped magnetic particles 18, at block 104 the ratio of the flake-shaped magnetic particles 18 to the second type of particles 26 may be increased in the longitudinal direction 24 along the sheet 16 from the first region 32 that is adjacent to the first end. 29 of the sheet 16 to the second region 34 that is adjacent to the second end 30 of the sheet. The density of the flake-shaped magnetic particles 18 and/or the ratio of the flake-shaped magnetic particles 18 to the second type of particles 26 are increased while the sheet 16 is being formed. The method 100 then moves on to block 106 where the flake-shaped magnetic particles 18 are aligned in the longitudinal direction. 24 along the sheet 16. The flake-shaped magnetic particles 18 may be aligned while the sheet 16 is being formed but prior to the non-magnetic matrix 28 curing or becoming solidified.

Once the steps in blocks 102, 104, and 106 are complete the method moves on to block 108 where the sheet 16 is rolled to form the magnetic inductor core 12. More specifically, the sheet is rolled in the longitudinal direction 24 to form the magnetic inductor core 12 such that the magnetic inductor core 12 defines the central orifice 36, such that the density of the flake-shaped magnetic particles 18 increases in the direction 38 that extends radially outward from the central orifice 36 along a cross-sectional area of the formed magnetic inductor core 12 from the first region 40 that is adjacent to the central orifice 36 to the second region 42 that is adjacent to the outer periphery 44 of the magnetic inductor core 12, and such that the magnetic permeability of the magnetic inductor core 12 increases in the direction 38 that extends radially outward from the central orifice 36 along the cross-sectional area of the formed magnetic inductor core 12.

Next, the method moves on to block 110 where the electrical conductor or wire 14 is disposed within the central orifice 36 of the magnetic inductor core 12. Alternatively, the sheet 16 may be rolled directly over the wire 14. The method 100 then moves on to block 112 where the inductor core 12 and the electrical conductor or wire 14 are collectively wound to form an inductor, such as the spiral-shaped inductor 10 illustrated in FIG. 1. The magnetic inductor core 12 or the inductor 10 as a whole may be heat treated or sintered at any point while forming magnetic inductor core 12 and the electrical inductor 10 according to method 100.

It should be understood that the flowchart in FIG. 5 is for illustrative purposes only and that the method 100 should not be construed as limited to the flowchart in FIG. 5. Some of the steps of the method 100 may be rearranged while others may be omitted entirely. It should be further understood that the designations of first, second, third, fourth, etc. for regions, directions, or any other component, state, or condition described herein may be rearranged in the claims so that they are in chronological order with respect to the claims.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. An inductor configured to store energy in a magnetic field comprising:

a magnetic core defining a central orifice, the magnetic core comprising a magnetic powder suspended in a non-magnetic matrix, the magnetic powder having spherically-shaped particles and flake-shaped particles that are arranged such that a ratio of the flake-shaped particles to the spherically-shaped particles varies in a direction that extends radially outward from the central orifice along a cross-sectional area of the magnetic core from a first region that is adjacent to the central orifice to a second region that is adjacent to an outer periphery of the magnetic core and such that a magnetic permeability of the magnetic core varies in the direction that extends radially outward from the central orifice along the cross-sectional area, of the magnetic core; and an electrical conductor disposed within the central orifice and configured to deliver electrical current to the inductor to generate the magnetic field.

2. The inductor of claim 1, wherein each of the flake-shaped particles have a pair of substantially parallel and planar exterior surfaces that are separated by a thickness of the flake-shaped particles, and wherein the pair of substantially parallel and planar exterior surfaces of each flake-shaped particle are arranged to extend concentrically about the central orifice.

3. The inductor of claim 1, wherein the magnetic core comprises a rolled sheet of material that is comprised of the magnetic powder suspended in the non-magnetic matrix.

4. The inductor of claim 1, wherein the magnetic core and electrical conductor are collectively wound into a spiral such that the inductor is a spiral inductor.

5. The inductor of claim 1, wherein the ratio varies from at most 2:1 to at least 100:1.

6. An inductor configured to store energy in a magnetic field comprising:

a wire configured to deliver electrical current to the inductor to generate the magnetic field; and a core disposed radially about the wire, the core comprising magnetic particles suspended in a non-magnetic matrix, wherein the magnetic particles are arranged such that a magnetic permeability of the core increases in a direction that extends radially outward from the wire along a cross-sectional area of the core from a first region that is adjacent to the wire to a second region that is adjacent to an outer periphery of the core.

7. The inductor of claim 6, wherein the magnetic particles comprise flake-shaped particles.

8. The inductor of claim 7, wherein the core further comprises non-magnetic particles suspended in a non-magnetic matrix.

9. The inductor of claim 8, wherein a ratio or the flake-shaped particles to the non-magnetic particles increases in a direction that extends radially outward from the wire along the cross-sectional area of the core.

10. The inductor of claim 9, wherein the ratio increases from at most 2:1 within the first region to at least 4:1 within the second region.

11. The inductor of claim 7, wherein each of the flake-shaped particles have a pair of substantially parallel and planar exterior surfaces that are separated by a thickness of the flake-shaped particles, and wherein the pair of substantially parallel and planar exterior surfaces of each flake-shaped particle are arranged to extend concentrically about the wire.

12. The inductor of claim 6, wherein the magnetic particles comprise flake-shaped particles and spherically-shaped particles.

13. The inductor of claim 12, wherein a ratio of the flake-shaped particles to the spherically-shaped particles increases in a direction that extends radially outward from the wire along the cross-sectional area of the core.

14. The inductor of claim 13, wherein the ratio increases from at most 2:1 within the first region to at least 4:1 within the second region.

15. The inductor of claim 12, wherein each of the flake-shaped particles have a pair of substantially parallel and planar exterior surfaces that are separated by a thickness of the flake-shaped particles, and wherein the pair of substantially parallel and planar exterior surfaces of each flake-shaped particle are arranged to extend concentrically about the wire.

16. The inductor of claim 6, wherein the core and electrical conductor are collectively wound into a spiral such that the inductor is a spiral inductor.

17. The inductor of claim 6, Wherein the core comprises a rolled sheet of material that is comprised of the magnetic powder suspended in the non-magnetic matrix.

* * * * *